US007404607B2

(12) United States Patent
Crue

(10) Patent No.: US 7,404,607 B2
(45) Date of Patent: Jul. 29, 2008

(54) EASY ASSEMBLY BARSTOOL

(75) Inventor: Dean Crue, Northbrook, IL (US)

(73) Assignee: Vendor Development Group, Chicago, IL (US)

( * ) Notice: Subject to any disclaimer, the term of this patent is extended or adjusted under 35 U.S.C. 154(b) by 0 days.

(21) Appl. No.: 11/650,221

(22) Filed: Jan. 4, 2007

(65) Prior Publication Data

US 2007/0188005 A1 Aug. 16, 2007

Related U.S. Application Data

(60) Provisional application No. 60/756,586, filed on Jan. 4, 2006.

(51) Int. Cl.
*A47C 4/02* (2006.01)

(52) U.S. Cl. ..... 297/440.1; 297/344.18; 297/445.1; 297/446.1; 297/461

(58) Field of Classification Search ..... 297/344.18, 297/344.12, 440.1, 440.15, 446.1, 446.2, 297/461, 440.21, 445.1
See application file for complete search history.

(56) References Cited

U.S. PATENT DOCUMENTS

| | | | | |
|---|---|---|---|---|
| 1,030,658 | A | 6/1912 | Gregory | |
| 1,922,418 | A | 8/1933 | Conant | |
| 2,640,527 | A * | 6/1953 | Kreizelman | 297/448.1 |
| 2,687,768 | A * | 8/1954 | Konkle | 297/446.1 |
| D182,125 | S * | 2/1958 | Kolbe | D6/380 |
| 2,933,850 | A | 4/1960 | Martin | |
| 2,952,300 | A | 9/1960 | Cohen | |
| 3,025,105 | A | 3/1962 | Nash | |
| 3,133,762 | A | 5/1964 | Newman | |
| 3,232,253 | A | 2/1966 | Winters | |
| 3,351,378 | A | 11/1967 | Bliss | |
| 3,446,530 | A | 5/1969 | Rowland | |
| 3,874,725 | A | 4/1975 | Perry | |
| 4,304,436 | A | 12/1981 | Rowland | |
| 4,341,419 | A | 7/1982 | Sebel | |
| 4,366,980 | A | 1/1983 | Rowland | |
| 4,456,296 | A | 6/1984 | Rowland | |
| 4,807,929 | A | 2/1989 | Balsbaugh | |
| 4,998,774 | A | 3/1991 | Huff et al. | |
| 5,002,337 | A | 3/1991 | Engel et al. | |
| 5,044,691 | A | 9/1991 | Guichon | |
| 5,060,896 | A | 10/1991 | Hobbins | |
| 5,524,963 | A | 6/1996 | Barile | |
| 5,536,068 | A | 7/1996 | Valentor et al. | |
| 5,588,624 | A * | 12/1996 | Woodham | 248/188.4 |
| 5,647,286 | A | 7/1997 | Dunn | |
| 5,678,892 | A | 10/1997 | Heitlinger | |
| 5,758,586 | A | 6/1998 | Keiser | |
| 5,762,396 | A | 6/1998 | Barile | |

(Continued)

FOREIGN PATENT DOCUMENTS

FR 2586916 B1 3/1987

(Continued)

*Primary Examiner*—Peter R. Brown
(74) *Attorney, Agent, or Firm*—McAndrews, Held & Malloy, Ltd.

(57) ABSTRACT

Certain embodiments of the present invention provide a bar stool that is easy to Additionally, certain embodiments of the present invention provide a bar stool that own into a flat disassembled state that is compact and cost effective for shipping.

9 Claims, 18 Drawing Sheets

U.S. PATENT DOCUMENTS 5,803,540 A 9/1998 Schwartz
5,845,962 A * 12/1998 Lin ..... 297/54
5,881,979 A 3/1999 Rozier et al.
6,447,070 B1 9/2002 Ekman et al.
6,702,384 B1 3/2004 Brown
2003/0052524 A1* 3/2003 Chiang ..... 297/440.1
2004/0041453 A1* 3/2004 Ellis et al. ..... 297/344.18

FOREIGN PATENT DOCUMENTS

WO WO9932015 B2 7/1999

* cited by examiner

EASY ASSEMBLY BARSTOOL

RELATED APPLICATIONS

This application claims the benefit of U.S. Provisional Patent Application No. 60/756,586 filed Jan. 4, 2006, entitled Easy Assembly Bar Stool, which is herein incorporated by reference in its entirety.

BACKGROUND OF THE INVENTION

The present invention generally relates to bar stools. More particularly, the present invention relates to bar stools that are easy to assemble and convenient and cost effective to ship.

Typically, bar stools are sold in a disassembled state to provide a convenient method for saving space for shipping. Even when disassembled, however, many bar stools are still heavy and bulky, as they contain several large pieces that do not condense and package compactly. Therefore, even in the unassembled state many barstools are still difficult and expensive to ship and transport.

Typically, unassembled bar stools also contain a large number of parts and pieces making assembly extremely complicated and requiring the use of several confusing steps. A large number of parts frequently leads to the misplacement of one or more required elements of the assembly, making the assembly more difficult, if not impossible.

Thus, a need has long existed for a bar stool that is easy to assemble. Additionally, a need exists for a bar stool that lies flat and is thereby convenient and cost effective to transport and ship.

BRIEF SUMMARY OF THE INVENTION

Certain embodiments of the present invention provide a bar stool that is easy to assemble. Additionally, certain embodiments of the present invention provide a bar stool that breaks down into a flat disassembled state that is compact and cost effective for shipping.

DETAILED DESCRIPTION OF THE INVENTION

Figure 1:
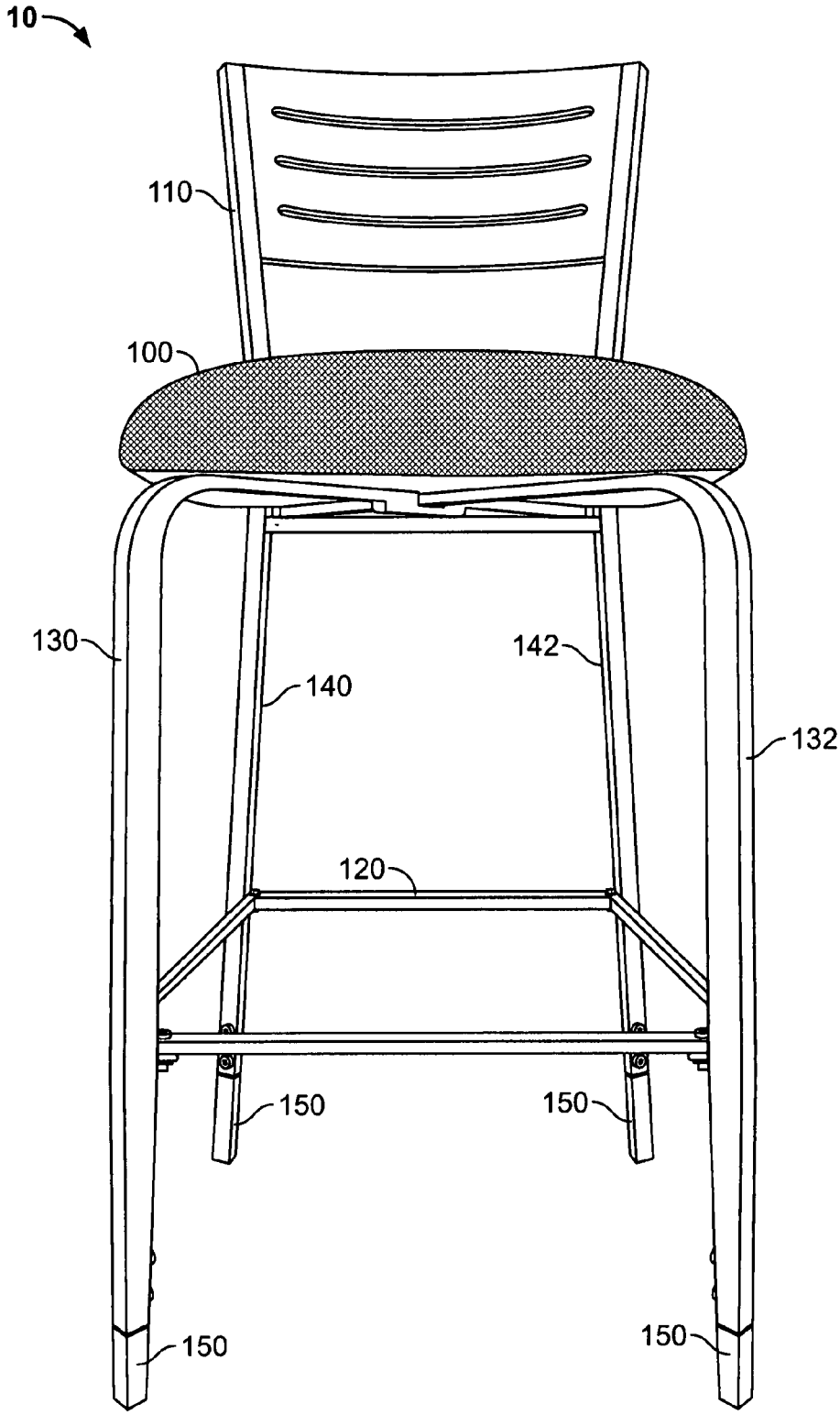
FIG. 1 illustrates a view of the front of the assembled bar stool.
Figure 2:
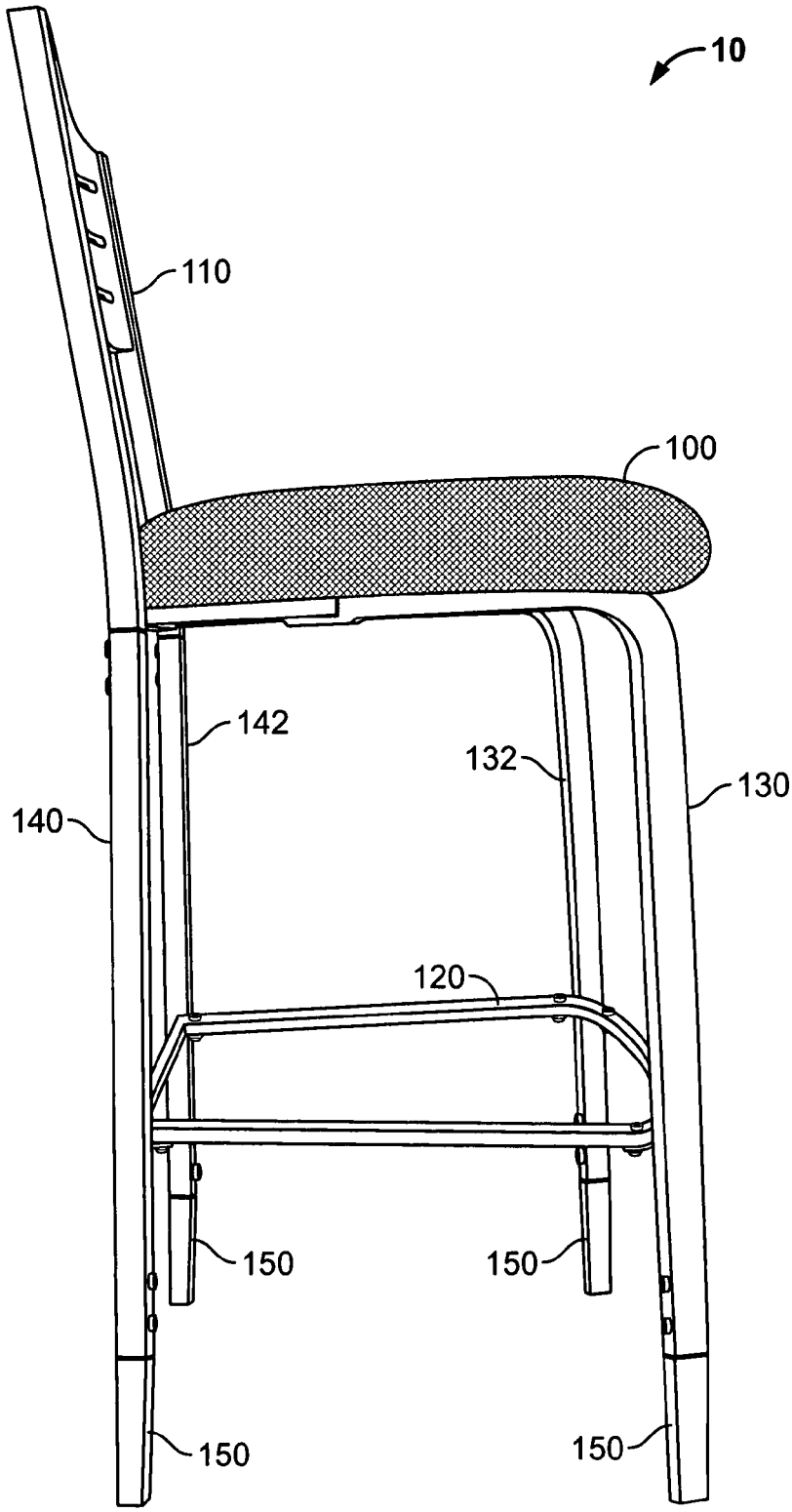
FIG. 2 illustrates a side view of the assembled bar stool.
Figure 3:
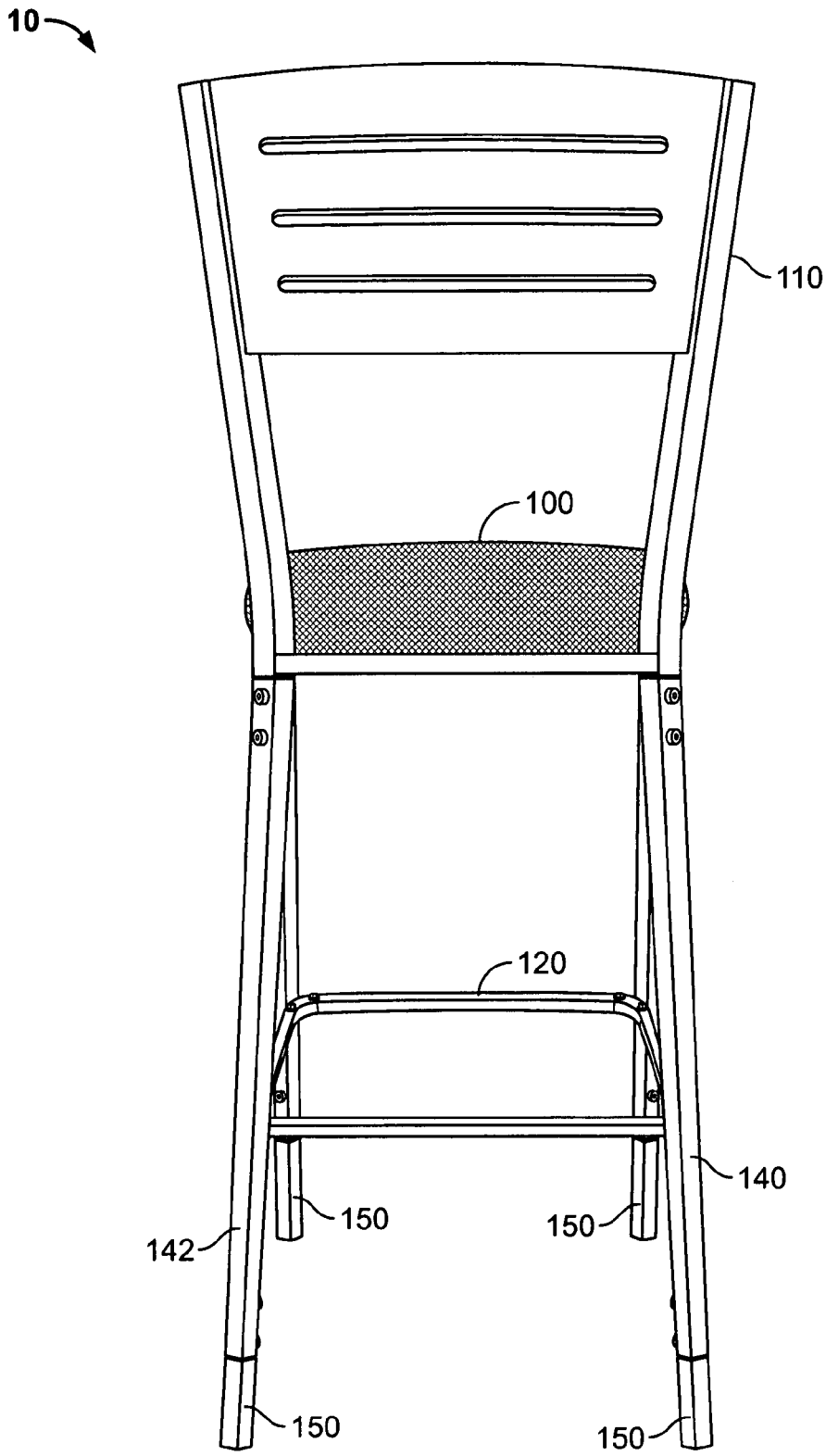
FIG. 3 illustrates a view of the rear of the assembled bar stool.
Figure 4:
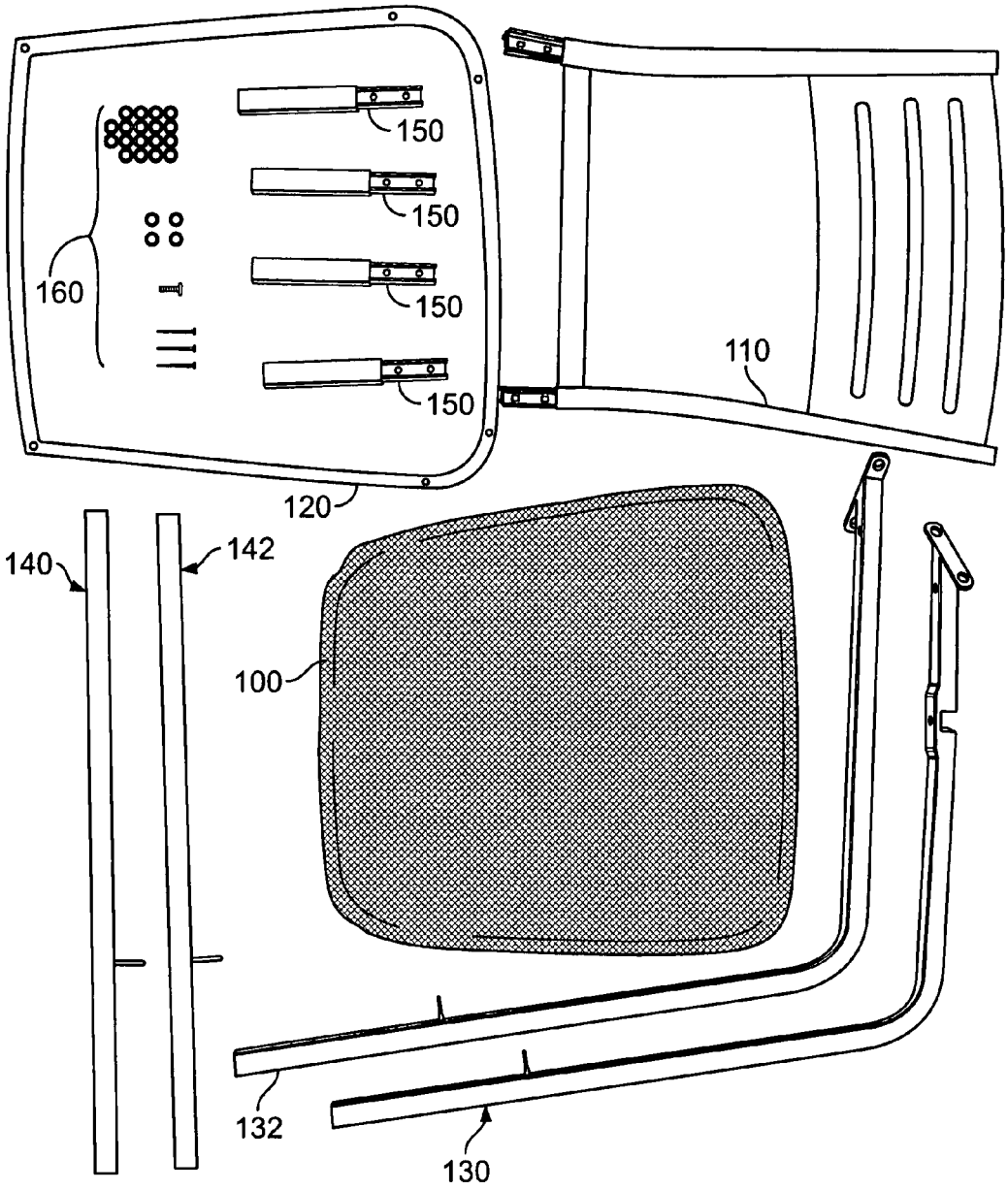
FIG. 4 shows the components of the bar stool unassembled.

FIGS. 1-3 illustrate various views of an easy assembly bar stool 10 according to an embodiment of the present invention in its assembled state. FIG. 4 illustrates the easy assembly bar stool in a disassembled state. The easy assembly bar stool 10 includes a seat 100, a backrest 110, a footrest 120, a first front leg structure 130, a second front leg structure 132, a first back leg structure 140, a second back leg structure 142, four leg extenders 150 and fastening elements 160.

In the assembled state of the bar stool 10, as shown in FIGS. 1-3, the backrest 110 is connected to the first back leg 140 and second back leg 142 to form the rear of the chair. The first front leg structure 130 crosses and connects with the second front leg structure 132 at a top portion of the front leg structures. The backrest 110 connects to the first front leg structure 130 and the second front leg structure 132 forming a plane at the top portion of the front leg structures upon which a seat 100 may be positioned and attached. The footrest 120 is attached to the back leg structures 140 and 142 and to the front leg structures 130 and 132. The leg extenders 150 are attached to the back leg structures 140 and 142 and the front leg structures 130 and 132. Each connection of the components of the assembled bar stool 10 is secured using the fastening elements 160, however, the connections may be secured by other methods. For example, certain connection points may be equipped with fittings to provide snap-in or slide-in connections, or threads to provide a connection by twisting the connection points together. As another example, fasteners 160 may include pins, rods, screws, bolts, nuts, wing-nuts, or snap fittings.

The bar stool 10 is preferably packaged in shipping material and shipped in an unassembled state in order to minimize the shipping space required for each bar stool. As shown in the FIG. 4, the components are generally flat and may be packaged in a container approximately the thickness of the seat 100.

The bar stool 10 may be assembled easily, preferably by using a screwdriver and/or an allen wrench, though other tools can be used, on the fastening elements 160 to join the components of the bar stool together. Note that although only three screws are shown in the fastening elements 160 of FIG. 4, preferably four screws are employed.

Additionally, the four leg extenders 150 may be of variable length in order to provide a bar stool with varying seat height. For example, the leg extenders may be four, six, or eight inches long. Furthermore, the leg extenders may be of such a length as to provide a seat height of about 18", 24", 30", 36", 42", 48" inches high, or any other height, so as to be compatible with various common table, counter or bar heights. A consumer may prefer one of the available heights of leg extenders in order to match a desired seat height for the bar stool with other furniture such as a bar, a table or a counter.

Figure 5:
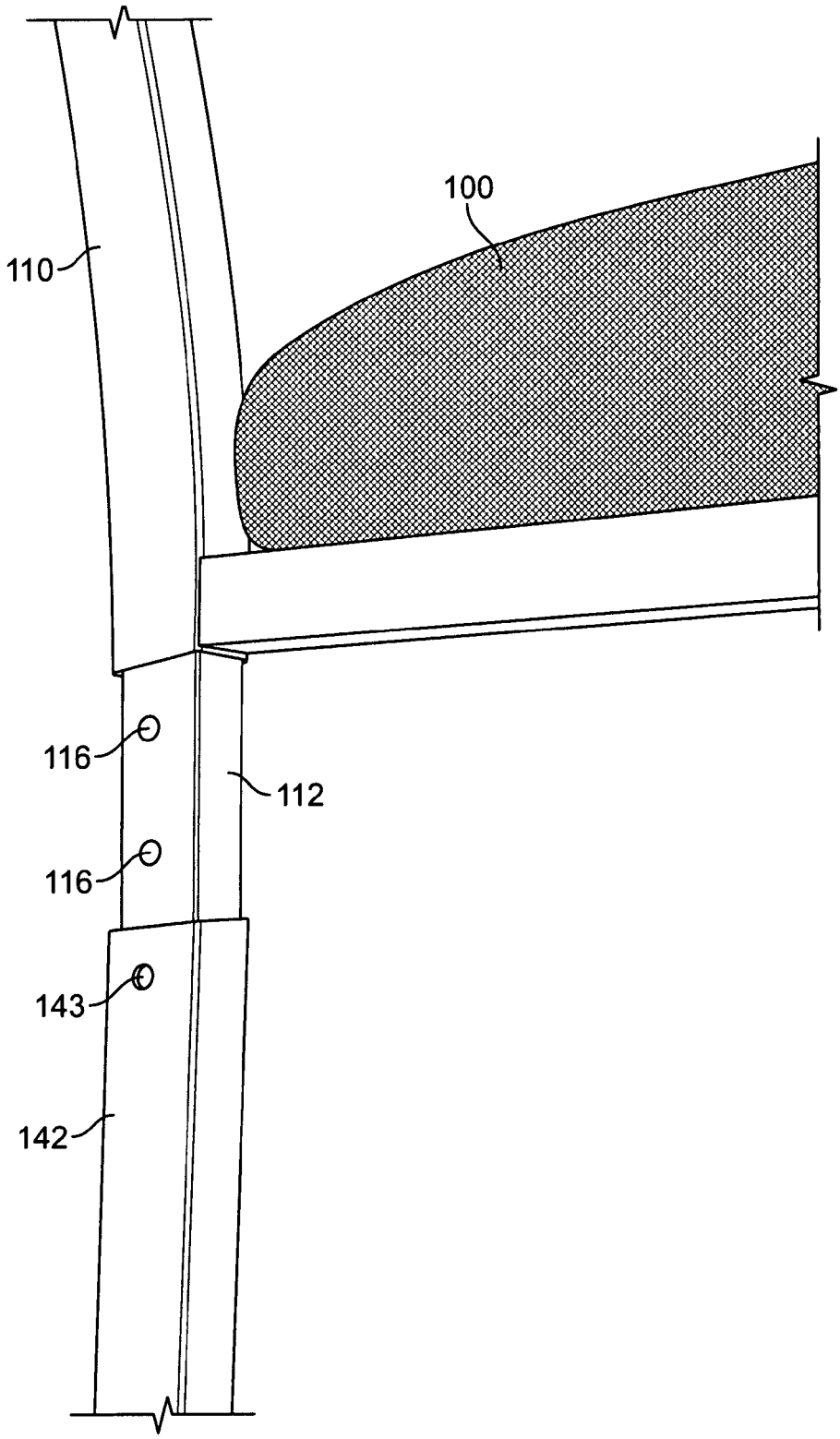
FIG. 5 shows the lower portion of the back rest sliding out of one of the back legs.

In operation, the bar stool may be assembled as follows. First, the lower portion of the backrest 110 is introduced into the top portions of each back leg structure 140 and 142 by sliding a first back leg connector portion 111 (shown in FIG. 4) of the backrest 110 into the hollow opening of the top of the first back leg 140 and sliding a second back leg connector portion 112 into the hollow opening on the top of the second back leg 142 and fastened using the supplied fasteners 160. FIG. 5 depicts the back leg connector portion 112 of the backrest 110 sliding into the back leg 142. Fasteners 160 slide through holes 143 of back leg 142 and holes 116 of the back leg connector portion 112 of the backrest 110 to firmly attach the back legs 140 and 142 to the backrest 110. Alternatively, as mentioned above, the back leg connector portion 112 of the backrest 110 and the hollow openings of the back legs 140 and 142 may be equipped with mating fittings to provide snap-in, slide-in or threaded connections.

Figure 6:
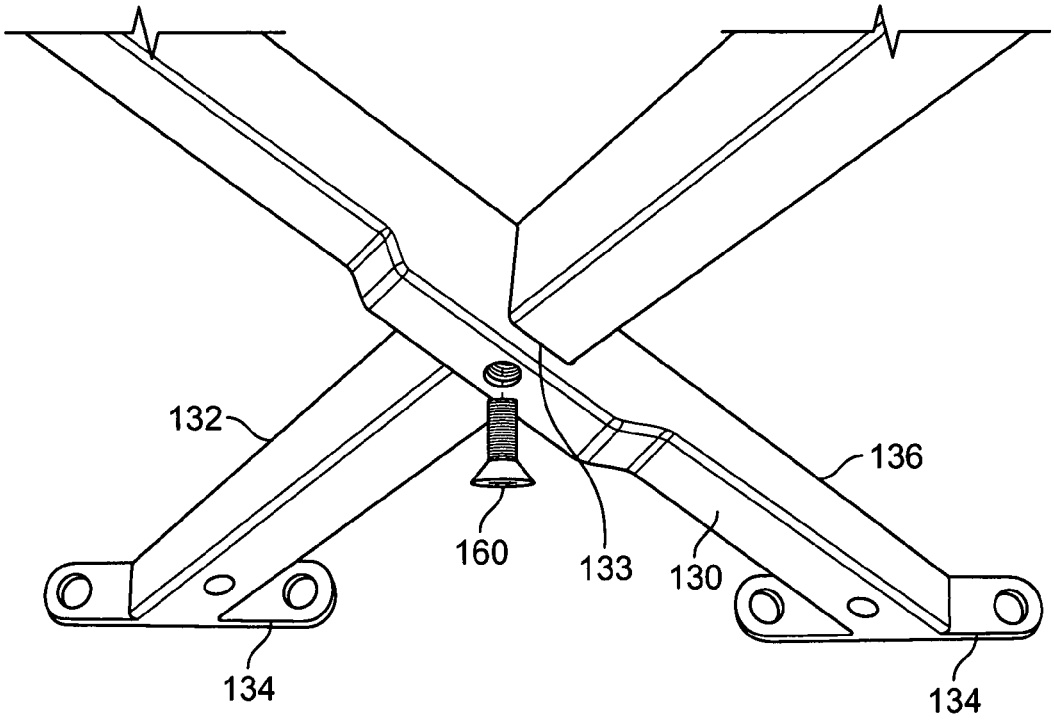
FIG. 6 is a view of the underside of the seat of the assembled stool.
Figure 7:
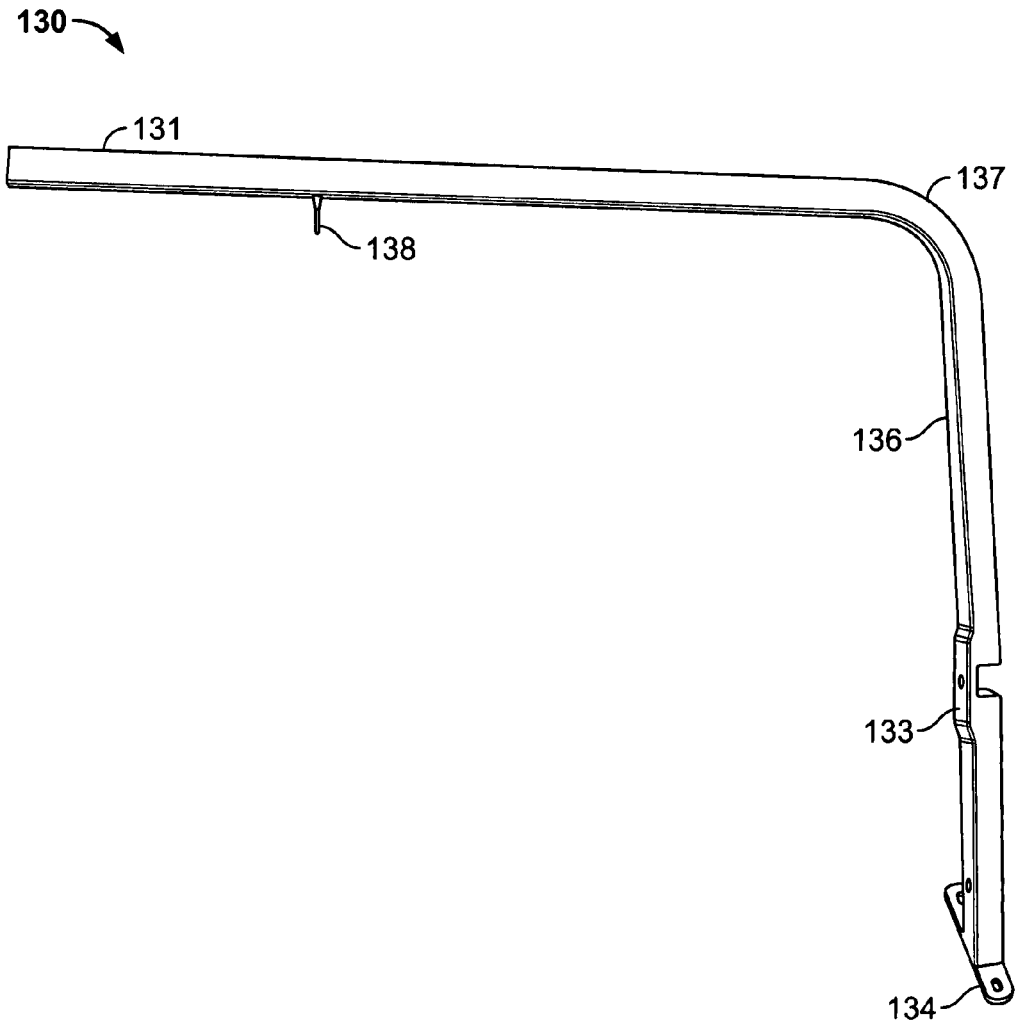
FIG. 7 illustrates a front leg structure of the stool.
Figure 8:
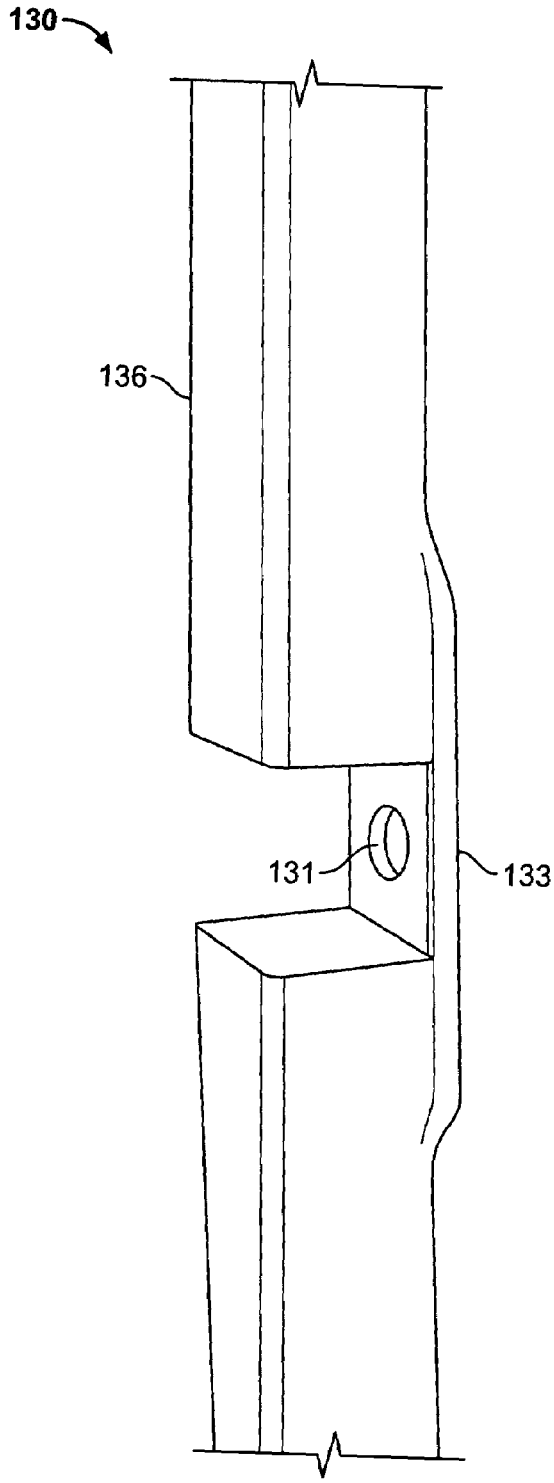
FIG. 8-9 are various close up views of one of the front legs.

Next, the front leg structures 130 and 132 are positioned to intersect and then fastened together as shown in FIG. 6. The first front leg structure 130 is depicted in FIG. 7. A bend 137 in the first front leg structure 130 establishes a horizontal portion 136 that is approximately perpendicular to the vertical portion 131 of the first front leg structure 130. The first front leg structure 130 attaches to the second front leg structure 132 at the horizontal portion 136 of the front legs 130 and 132. A recessed portion in the first front leg structure 130 establishes a channel 133 (shown in detail in FIG. 8) for the second front leg structure 132 to intersect the first leg structure 130 in a horizontal plane. A hole (not shown) in the second front leg 132 aligns with a hole 131 of the first front leg such that a fastener 160 can be inserted through both structures. The two front legs 130 and 132 are then attached using one or more fasteners 160 as shown in FIG. 7.

Figure 9:
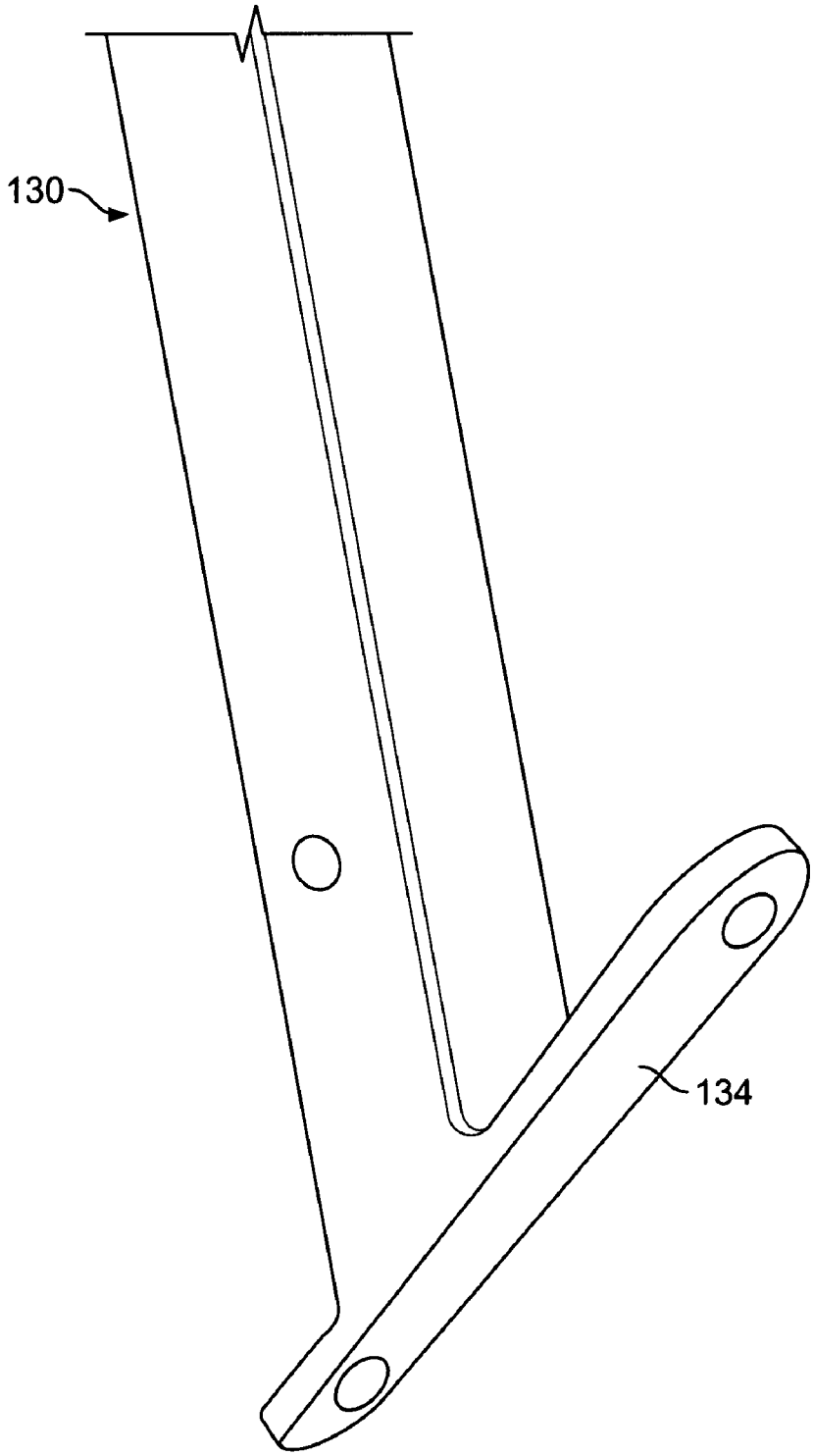
Figure 10:
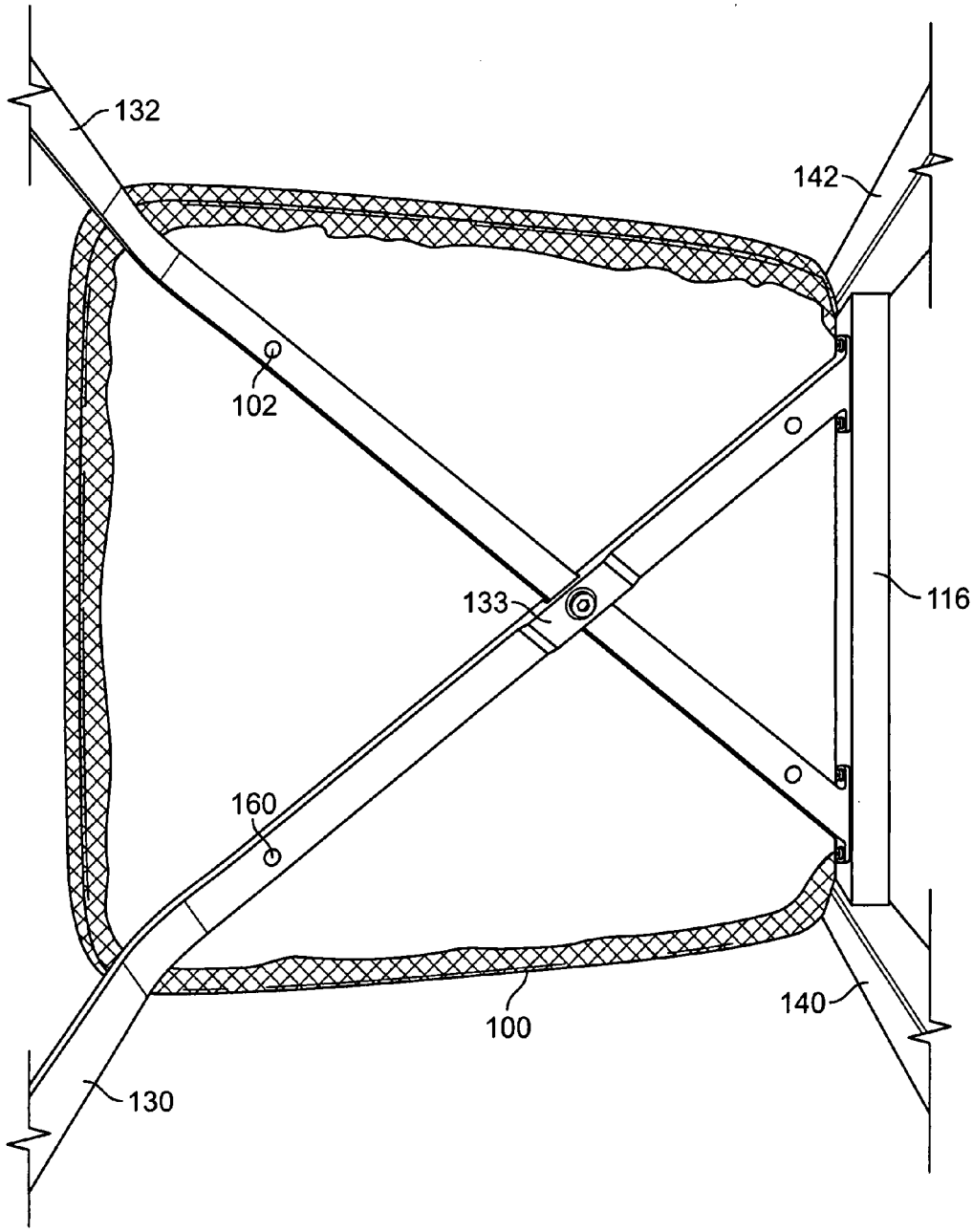
FIG. 10 is a close up view of the crossing connection of the two front leg structures.

Next, the front leg structures 130 and 132 attach to the backrest 110 via a backrest connector surface 134 (shown in detail in FIG. 9) on each of the front leg structures 130 and 132. The assembly of the front leg structures 130 and 132 to the backrest 110 is shown in FIG. 10. The backrest connector surface 134 of each front leg structure 130 and 132 lies flush against the surface of the backrest 110 and is attached using one or more fasteners 160. Fasteners 160 may include a nut, washer and bolt, or a single screw in the alternative. Alternatively, the backrest connector surfaces 134 and the backrest 110 may be equipped with mating parts to provide a snap-in or slide-in connection.

Figure 11:
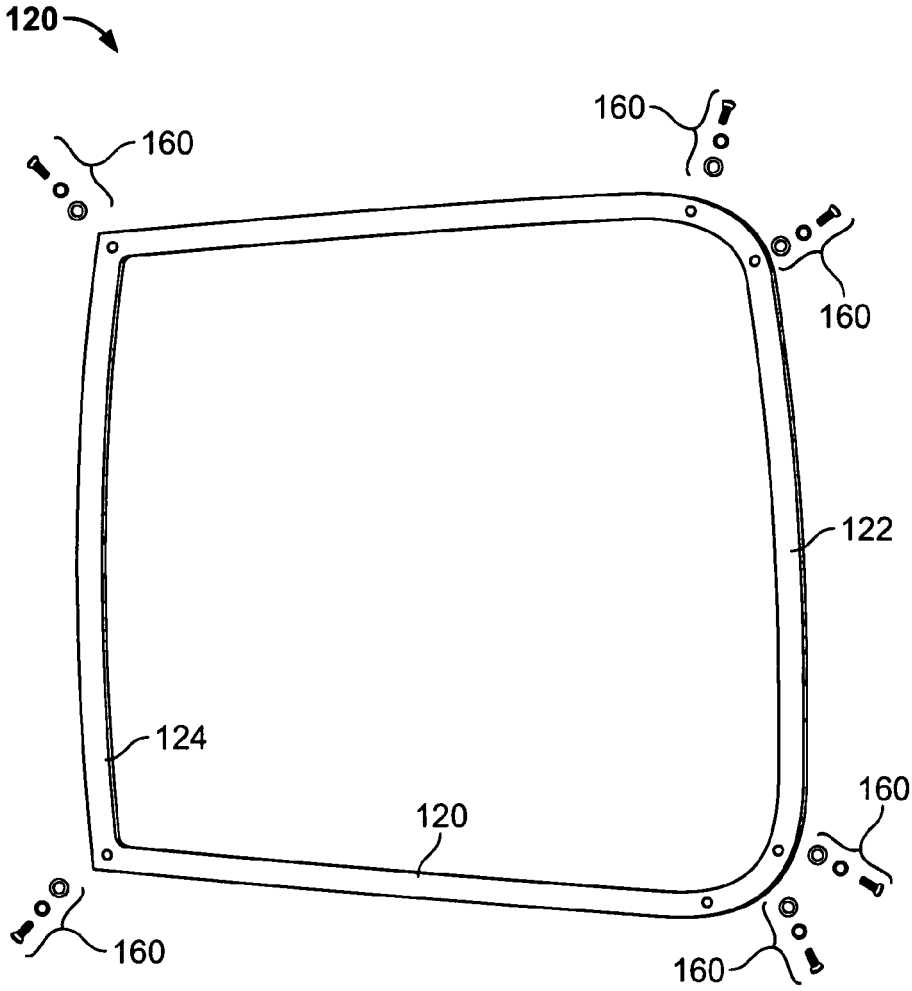
FIG. 11 illustrates the footrest in an unassembled state.
Figure 12:
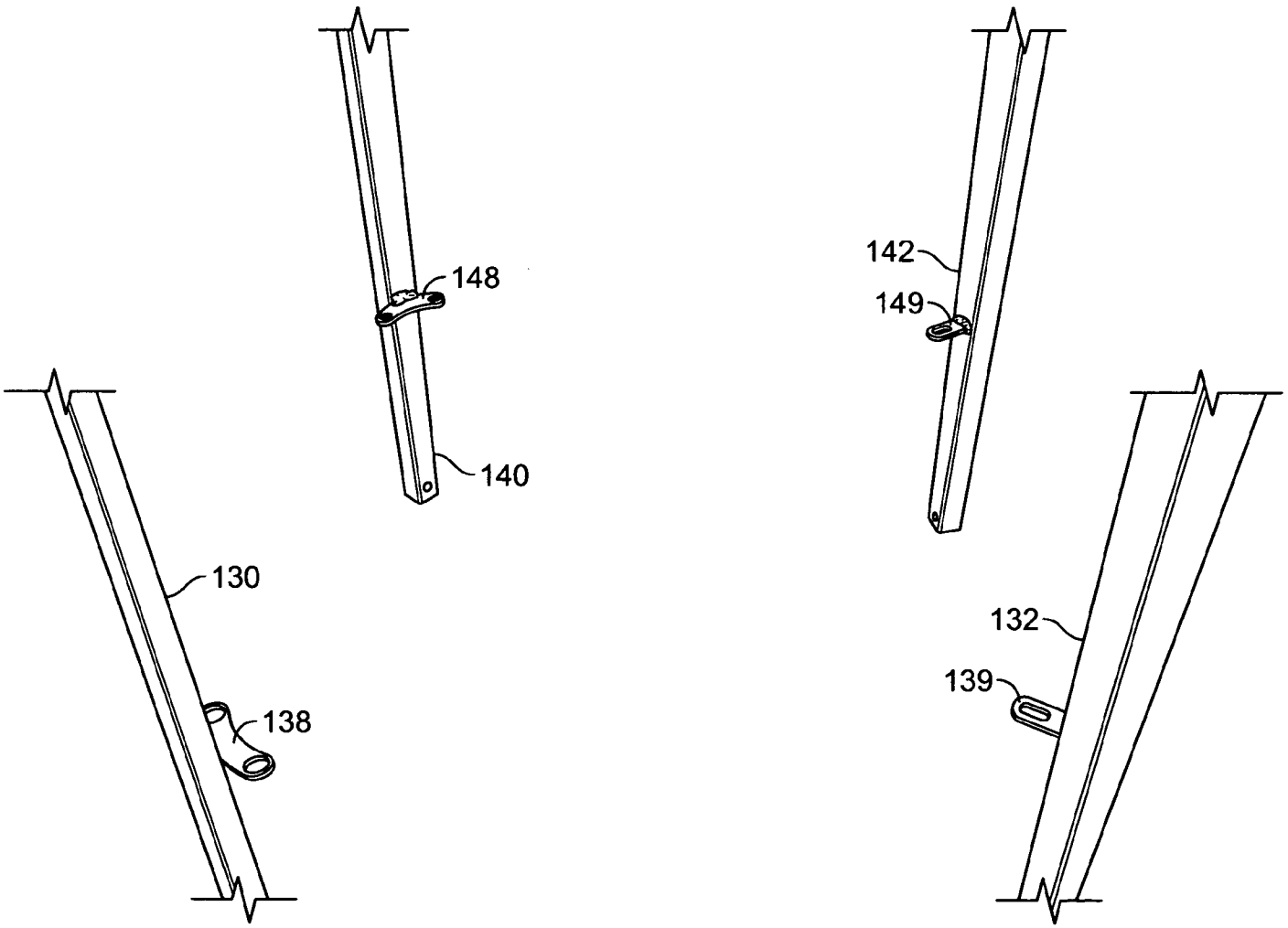
FIG. 12 illustrates the front and back legs prior to the installation of the footrest.

Next, the footrest 120 is attached to the back leg structures 140 and 142 and the front leg structures 130 and 132. FIGS. 11-14 depict the footrest 120 as it connects to the bar stool 10. FIG. 11 depicts the footrest 120 and fasteners 160 in an unassembled position to connect to the bar stool 10. The front portion 122 of the footrest 120 attaches to the front leg structures 130 and 132, while the rear portion 124 attaches to the rear leg structures 140 and 142. FIG. 12 depicts the legs of the bar stool 130, 132, 140 and 142 prior to assembly of the footrest. Font leg structures 130 and 132 comprise front footrest connection surfaces 138 and 138 for attaching to the front portion 122 of the footrest 120. Back leg structures 140 and 142 comprise back footrest connection surfaces 148 and 149 for attaching to the back portion 124 of the footrest 120.

Figure 13:
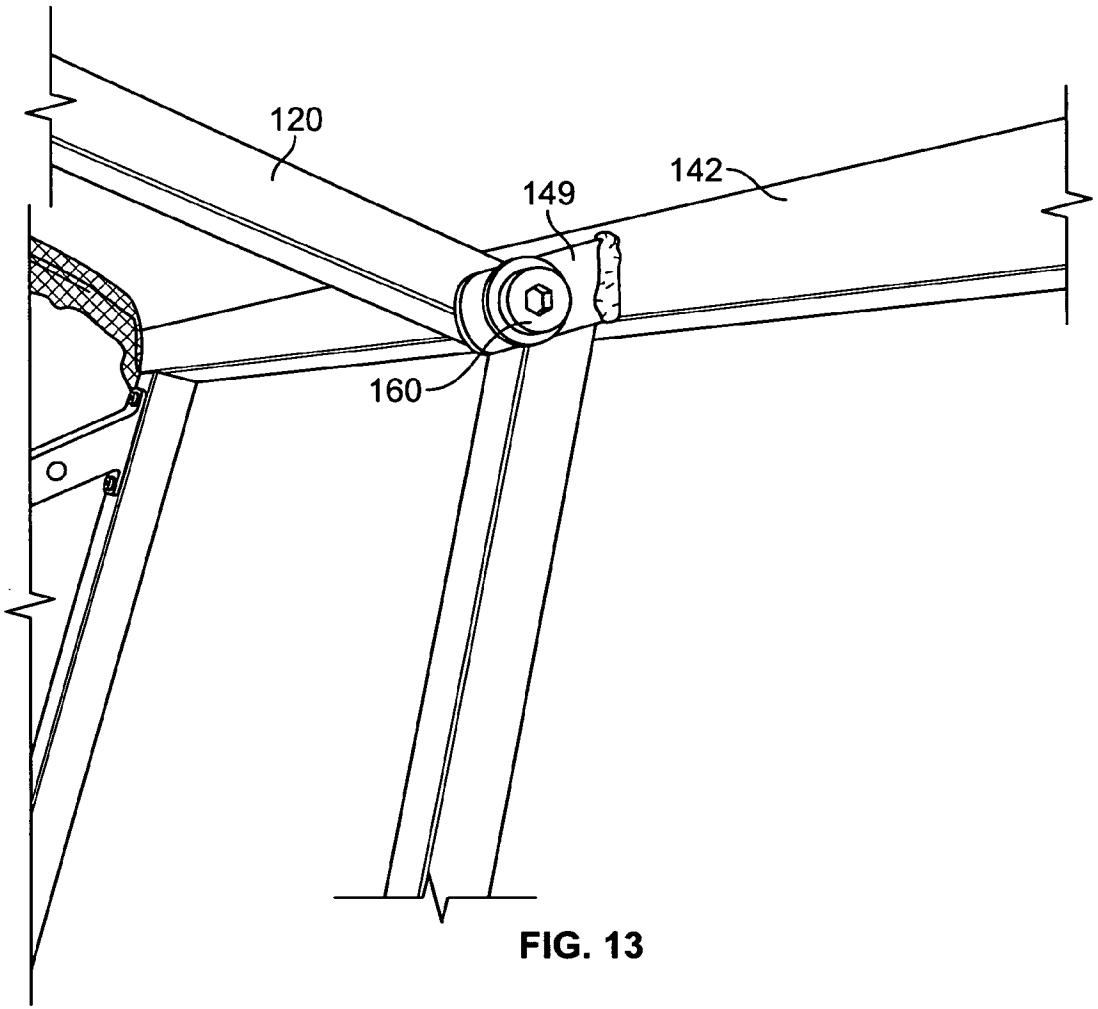
FIG. 13 shows the footrest connected to one of the back legs.
Figure 14:
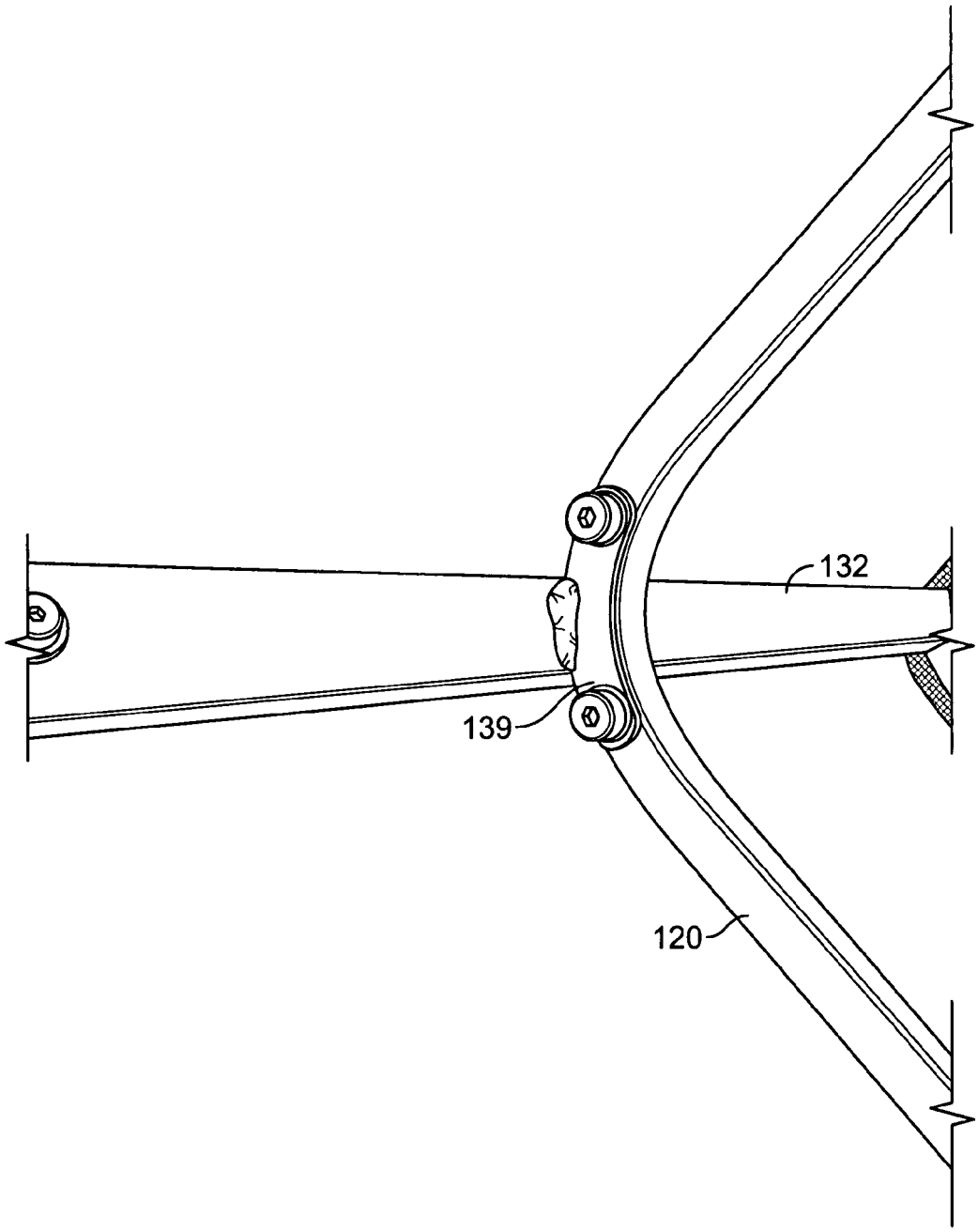
FIG. 14 shows the footrest connected to one of the front legs.

In assembly, the footrest 120 is rested upon the front and back footrest connection surfaces 138, 139, 148 and 149 and fastened using fasteners 160. FIG. 13 depicts a view from the bottom of the bar stool 10 looking up at the back portion 122 of the footrest 120 as it connects with the back footrest surface 149 of the second back leg structure 142 using fasteners 160. FIG. 14 depicts a view from the bottom of the bar stool 10 looking up at the connection of the front portion 122 of the footrest 120 to the front leg surface 139 of the second front leg structure 132.

Figure 15:
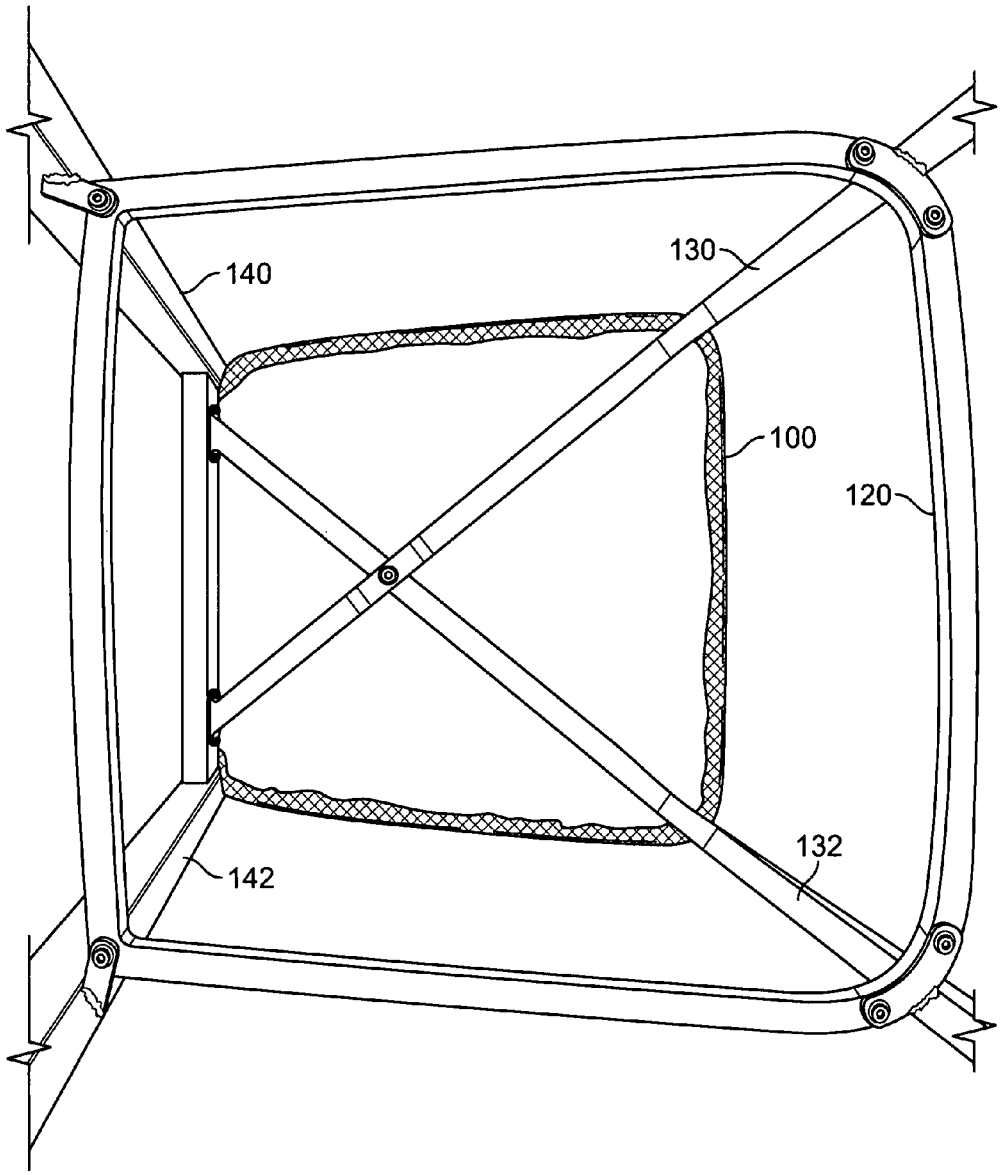
FIG. 15 is a view upwards from below the bar stool.

Next, the seat 100 is attached to the upper sides of the horizontal portion 136 of the front leg structures 130 and 132. The horizontal portion 136 of the front leg structures 130 and 132 form a flat, horizontal surface upon which the seat 100 lies. FIGS. 7 and 15 depict views from underneath the bar stool 10 looking upwards at the seat 100. Once positioned, fasteners 160 inserted into holes 102 on the font leg structures 130 and 132 hold the seat 100 in place. Though it is depicted that the fasteners 160 holding the seat 100 in place are screws penetrating into and gripping the bottom surface of the seat, other methods for attaching the seat to the bar stool 10 are contemplated. For example, the seat 100 may be attached to the bar stool using an adhesive, or via clamps on either the bottom surface of the seat 100 or the bar stool 10. Alternatively, the seat may couple with the front legs 130 and 132 to form a snap-in or slide-in coupling.

Figure 16:
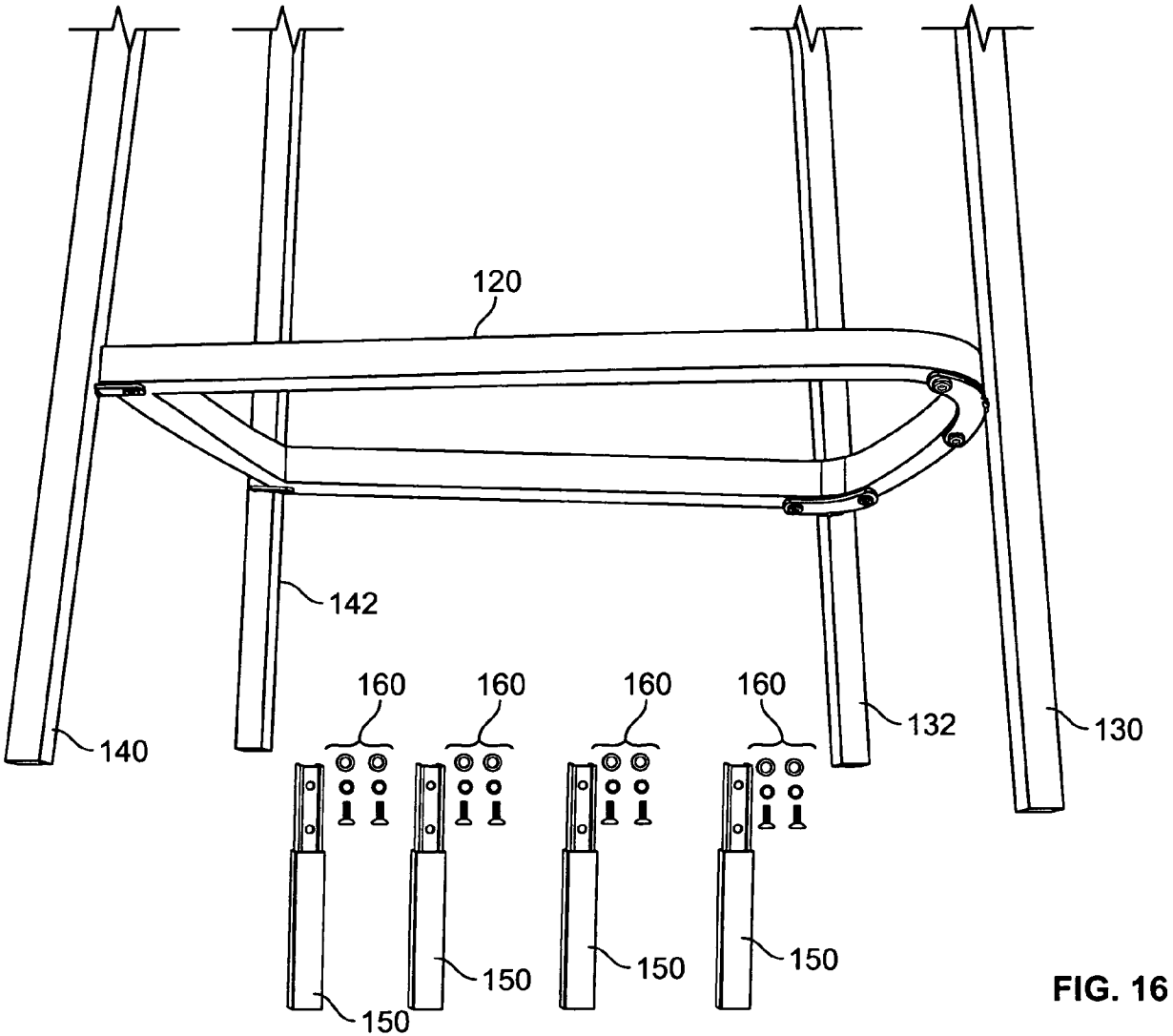
FIG. 16 shows the lower portions of the front and back legs and the leg extenders prior to assembly.
Figure 17:
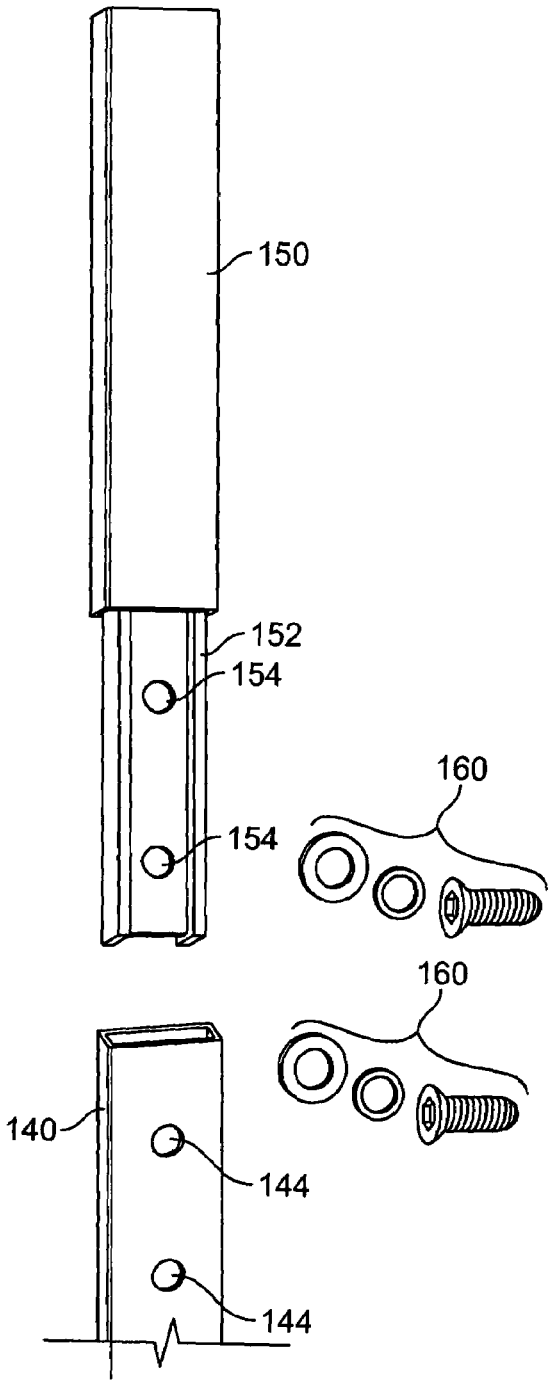
FIG. 17 is a view of a leg extender positioned relative to a leg in an unassembled configuration with the fasteners used to fasten the leg extender and the leg.
Figure 18:
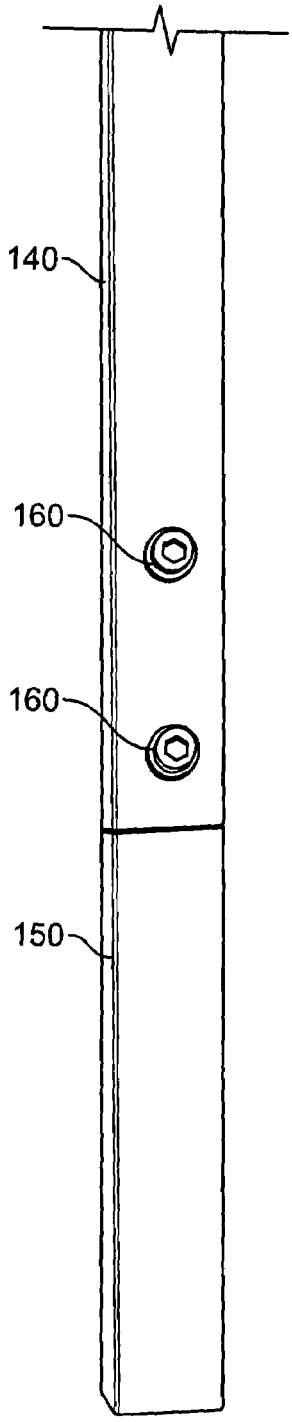
FIG. 18 is a view of one of the legs and leg extenders as assembled.

Finally, the leg extenders 150 are inserted into the lower portions of the front leg structures 130 and 132 and back leg structures 140 and 142 and fastened into place. FIG. 16 depicts the bar stool 10, the leg extenders 150 and fasteners 160 prior to the assembly. FIG. 17 depicts a close up view of a leg extender 150 as it connects with the back leg structure 140. A leg extender connector portion 152 is inserted into the hollow opening on the bottom of the back leg structure 140 and secured with fasteners 160 that slide through holes 144 of the back leg structure 140 and holes 154 of the leg extender 150. FIG. 18 shows a close up view of a leg extender 150 as connected with the back leg structure 140 of the bar stool.

As noted, alternative embodiments of the leg extenders 150 may be of various lengths to set the seat 100 at a height of 18", 24", 30", 36", 42", 48" or any height at the user's selection such that the bar stool 10 may be compatible with furniture of various heights or comfortable in a particular environment.

Additionally, the leg extender connector portions 152 may be equipped with a plurality of holes 154 such that the seat 100 height of the bar stool may be adjusted without use of a different sized leg extender 150.

The easy assembly bar stool 10 comprises a small number of parts. Only a seat 100, a backrest 110, two back legs 140 and 142, two front legs 130 and 132 and a footrest 120 are required along with fasteners to constitute the bar stool 10. Furthermore, the fasteners 160 are constructed such that each particular type of fastener is mean to be used with one particular tool, such as an allen wrench or a screwdriver, regardless of the size of the fastener. Accordingly assembly of the bar stool 10 requires few steps, few parts and few tools, making assembly easy.

Additionally, when disassembled, each individual component of the bar stool breaks down to a thickness no greater than that of the seat 100. The bar stool 10 may therefore be condensed to a compact package approximately the same thickness as that of the seat 100. Accordingly, the above described invention satisfies a long felt need for a bar stool that is easily assembled and compact for shipping and delivery purposes.

Alternatively, certain embodiments of the present invention may be implemented on other furniture such as tables, chairs, bars, cabinets or dressers.

Figure 19:
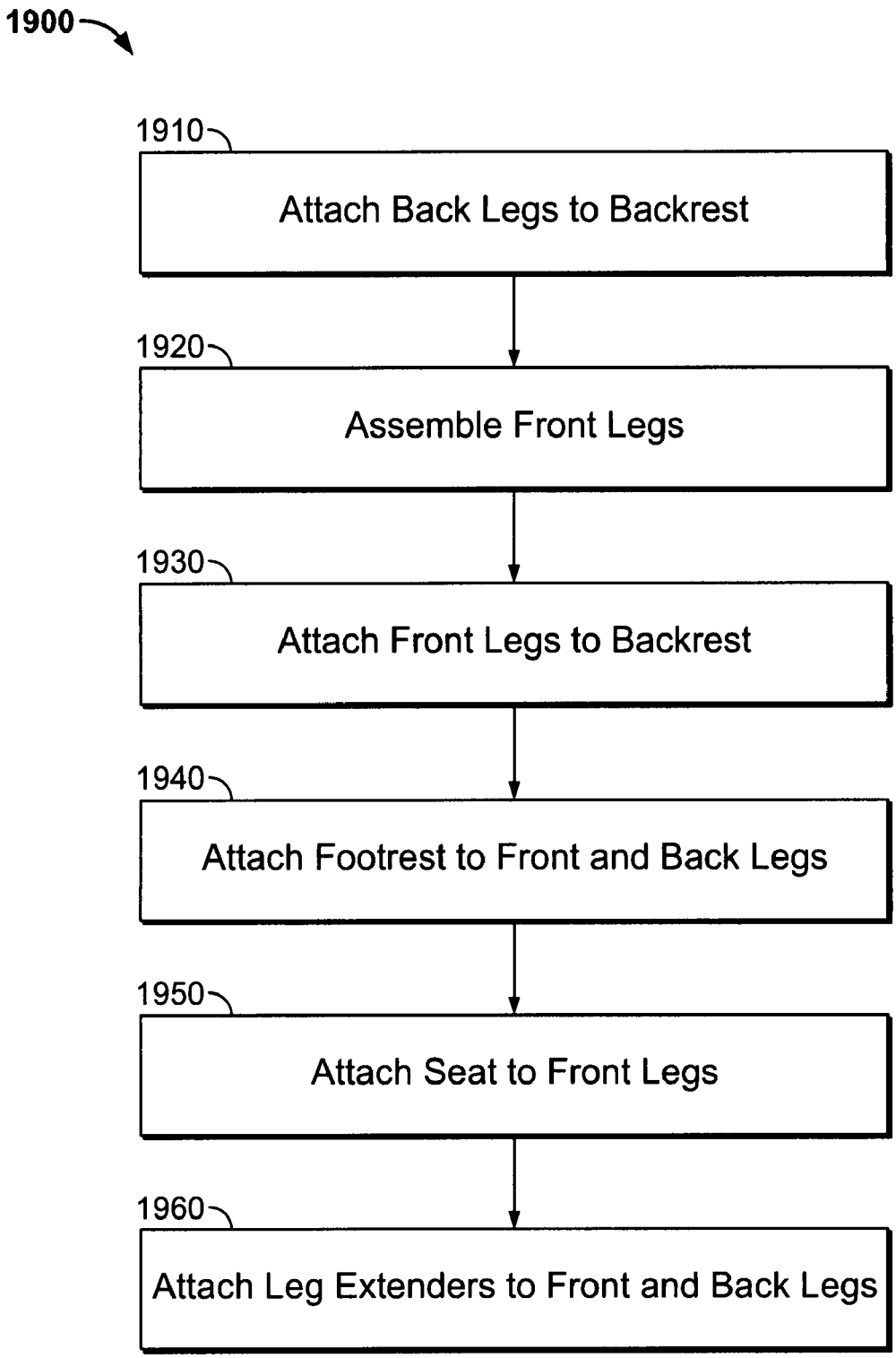
FIG. 19 illustrates a flow diagram of a method for assembling a bar stool according to an embodiment of the present invention.

FIG. 19 illustrates a flow diagram of method 1900 for assembling a bar stool according to an embodiment of the present invention. The method 1900 includes the following steps, which are described in more detail below. The method 1900 is described with reference to the elements of the bar stool 10, but it should be understood that other implementations are possible. For example, certain embodiments of the present invention may be implemented on other furniture such as tables, chairs, bars, cabinets or dressers.

At step 1910, a backrest 110 is attached to back leg structures 140 and 142. In this step, a user first selects backrest 110 and locates the back leg connector portions 111 and 112 on the bottom portion of the backrest 110. The user then selects the first back leg structure 140 and inserts the first back leg connector 111 into the opening on the top of the first back leg structure 140. The back leg structure is then fastened by inserting a fastener 160 into holes 143 on the back leg structure 140 which aligns with holes 116 on the inserted back leg connector portion 111. The fasteners are tightened using a screwdriver and/or an allen wrench. The user then connects the second back leg structure 142 with the second back leg connector portion 112 of the backrest 110 using the same method, and fastens using one or more of the fasteners 160.

Alternative methods for fastening the back leg connector portions 111 and 112 with the back leg structures 140 and 142 may be implemented, such as the use of a snap-in or slide-in coupling, or a threaded connection fastened by the twisting and tightening of the back leg structures 140 and 142.

At step 1920, the front leg structures 130 and 132 are assembled. In this step the user first selects the first front leg structure 130 and locates a channel 133 including a hole 131. The user then selects the second front leg structure 132 and inserts the second front leg 132 into the channel 133 of the first front leg 130 such that the hole 131 of the first front leg 130 aligns with a hole in the second front leg 132. The front legs are then fastened together by inserting and fastening one or more of the fasteners 160 through the hole 131 of the first and second front leg structures 130 and 132.

At step 1930, the front leg structures 130 and 132 are attached to the backrest 110. In this step the user first locates backrest connector surfaces 134 on each of the adjoined front leg structures 130 and 132 and aligns the holes of the surfaces 132 with holes on the front portion of the backrest 110. The user then fastens the front leg structures 130 and 132 with the back rest 110 using one or more fasteners 160.

Alternatively, the user may fasten the front legs 130 and 132 to the backrest 110 using other methods such as a snap-in fit or a slide-in fit if the components of the bar stool 10 are equipped with the appropriate elements for such a fastening.

After step 1930 the front legs 130 and 132 will form a horizontal surface nearly perpendicular to the backrest surface when the bar stool 10 is in the upright standing position.

At step 1940, the footrest 120 is attached to the front and back legs of the bar stool 10. In this step the user first selects footrest 120 and locates the front portion 122 and the back portion 124 of the footrest 120. Next the user locates the front footrest connection surfaces 138 and 139 on the front leg structures 130 and 132, and the back footrest connection surfaces 148 and 149 on the back leg structures 140 and 142 of the bar stool 10. The user then rests the footrest 120 upon the front and back footrest connection surfaces 138, 139, 148, and 149 such that the front portion 122 of the footrest 120 aligns with the front footrest connection surfaces 138 and 139 and the back portion 124 of the footrest 120 aligns with the back footrest connection surfaces 148 and 149. The footrest 120 is then fastened to the front legs 130 and 132, and the back legs 140 and 142 using one or more fasteners 160. The fasteners 160 may include, for example, pins, rods, screws, bolts, nuts, wing-nuts, and snap fittings.

Alternative methods of fastening the footrest 120 to the bar stool 10 such as use of a snap-in fitting, a slide-in fitting, or a clamp may also be administered where the components of the bar stool 10 are equipped with the proper elements for such a fastening.

At step 1950, the seat 100 is attached to the front leg structures 130 and 132. In this step the user first selects the seat 100 and rests the seat upon the horizontal surface of the front leg structures. The user next fastens the seat 100 to the bar stool 10 by inserting fasteners 160 through holes 102 on the underside of the horizontal surface of the front leg structures 130 and 132 and into the seat 100.

The user may fasten the seat 100 to the bar stool 10 using alternative fastening methods such use of an adhesive substance, or the use of snap-in or slide in fittings, or clamps on the underside of the seat 100 if the seat 100 is equipped with the proper elements for such a fitting.

At step 1960, the leg extenders may be optionally attached to the legs of the bar stool 10. In this step the user first selects a leg extender 150 and locates a leg extender connector portion 152 including holes 154. Next the user inserts the leg extender into one of the legs of the bar stool 10 and aligns holes 154 of the leg extender with holes 144 of the legs. The leg extender is then fastened to the leg of the bar stool 10 using one or more of the fasteners 160. The method is repeated with each leg extender 150 into a different leg of the bar stool 10.

The user may fasten the leg extenders to the legs of the bar stool 10 using alternative fastening methods such as a snap-in, a slide in or a threaded fitting if the components of the bar stool 10 are equipped with the proper elements for such a fitting.

Certain embodiments of the present invention may omit one or more of these steps and/or perform the steps in a different order than the order listed. For example, some steps may not be performed in certain embodiments of the present invention. As a further example, certain steps may be performed in a different temporal order, including simultaneously, than listed above While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An easy assembly bar stool including:

a first curved leg including a substantially vertical component and a substantially horizontal component;

a second curved leg including a substantially vertical component and a substantially horizontal component, wherein said substantially horizontal component of said second curved leg includes a channel to accommodate said first curved leg;

a first back leg;

a second back leg, wherein each of said first curved leg, said second curved leg, said first back leg, and said second back leg is a separate component; and a backrest including at least two back leg connector portions, wherein said backrest is a separate component from said first back leg and said second back leg, wherein said first back leg and said second back leg are each adapted to receive a connector portion from said backrest, wherein said backrest also includes a plurality of connector surfaces, wherein each of said first curved leg and said second curved leg is adapted to attach to at least one of said connector surfaces.

2. The bar stool of claim 1 wherein a seat is adapted to attach to at least one of said first curved leg and said second curved leg.

3. The bar stool of claim 1 wherein at least one of said first curved leg and said second curved leg is adapted to receive one of a set of leg extenders in a lower portion.

4. The bar stool of claim 3 wherein at least one of said first back leg and said second back leg is adapted to receive one of a set of leg extenders in a lower portion.

5. The bar stool of claim 4 wherein said set of leg extenders have a first length.

6. The bar stool of claim 5 further including a second set of leg extenders of a second length different from said first length that is also receivable by said at least one of said first back leg and said second back leg and said at least one of said first curved leg and said second curved leg.

7. The bar stool of claim 1 wherein at least one of said first back leg and said second back leg is adapted to receive one of a set of leg extenders in a lower portion.

8. The bar stool of claim 1 further including a footrest attached to at least one of said first curved leg and said second curved leg.

9. The bar stool of claim 8 wherein said footrest is adapted to be attached to at least one of said first back leg and said second back leg.

* * * * *